US005820928A

United States Patent [19]

Groshens

[11] Patent Number: 5,820,928

[45] Date of Patent: Oct. 13, 1998

[54] FUSIBLE INTERLINING AND ITS MANUFACTURING PROCESS

[75] Inventor: Pierrot Groshens, Peronne, France

[73] Assignee: Lainiere De Picardie, Buire Courcelles, France

[21] Appl. No.: 806,716

[22] Filed: Feb. 27, 1997

[30] Foreign Application Priority Data

Feb. 29, 1996 [FR] France ..... 96 02555

[51] Int. Cl.[6] ..... B05D 1/28; B05D 1/40

[52] U.S. Cl. ..... 427/194; 427/195; 427/197; 427/202; 427/375

[58] Field of Search ..... 427/179, 195, 427/197, 202, 261, 288, 412, 194, 375; 428/317.9, 423.1; 101/129

[56] References Cited

U.S. PATENT DOCUMENTS

| | | | |
|---|---|---|---|
| 4,204,017 | 5/1980 | Hefele | 428/160 |
| 4,571,351 | 2/1986 | Schaetti | 427/288 |
| 4,906,492 | 3/1990 | Groshens | 427/148 |
| 5,439,737 | 8/1995 | Trabelsi | 428/317.7 |
| 5,569,348 | 10/1996 | Hefele | 156/239 |

FOREIGN PATENT DOCUMENTS

| | | | |
|---|---|---|---|
| 2177038 | 2/1973 | France | C09J 5/00 |
| 2 241 604 | 8/1974 | France | C09J 7/00 |
| 2672313 | 2/1991 | France | D06M 23/14 |

*Primary Examiner*—Shrive Beck
*Assistant Examiner*—Fred J. Parker
*Attorney, Agent, or Firm*—Michael D. Bednarek; Kilpatrick Stockton LLP

[57] ABSTRACT

The invention concerns a process for manufacturing a fusible interlining (1) wherein a base fabric (2) receives a coating of thermofusible polymers distributed in points (3), characterised in that the following steps are successively carried out: depositing a sublayer (5) of polymers on a transfer medium (6, 7) comprising a regular and smooth surface; transferring the points thus obtained onto the base fabric (2); applying the thermofusible particles (10) on the sublayer (5); running the fusible interlining (1) thus obtained through a heating and/or radiation chamber (12).

11 Claims, 2 Drawing Sheets

FUSIBLE INTERLINING AND ITS MANUFACTURING PROCESS

BACKGROUND OF THE INVENTION

The invention concerns a fusible interlining and its manufacturing process.

It is known to achieve fusible interlinings made up of a base fabric on which a layer of thermofusible polymers distributed in points is deposited by coating.

These interlinings are specifically intended to be bonded on another textile, a cloth for example, so as to make up a complex whose physical properties, i.e. strength, springiness, softness, feel, volume, hand etc. can be controlled.

These properties of the complex result from the nature of the cloth, the nature of the base fabric, of the interlining, and also the nature of the composition and mode of application of the thermofusible layer.

Once manufactured, the fusible interlining must be able to withstand storage at ambient temperature. It is then necessary that the various layers of this product, generally stored in rolls, do not adhere to one another. The fusible interlining must not have a sticky effect or adhesive properties at ambient temperature ("tack").

The fusible interlining is subsequently bonded on the cloths so as to obtain the complex wanted.

This bonding is usually achieved using a press operating at temperatures comprised between 90° C. and 160° C. under pressures ranging from a few decibars to a few bars during relatively short periods of time, in the order of 10 to 30 seconds.

During this phase, the thermofusible polymers of the interlining must at least partially recover their adhesive properties.

In the course of this operation, it is also necessary to avoid that these thermofusible polymers traverse the cloth or produce returns, i.e. traverse the base fabric of the interlining. But nowadays, all fusible interlinings are designed so as not to traverse to the cloth side.

Indeed, such traverses and returns would produce an unaesthetic effect, making the interlining unfit for use or, at all events, giving the complex unsuitable properties contrary to those wanted.

Such traverse has the following main consequences:

- it brings about the migration of part of the thermofusible polymers to the face opposite to the initially fusible face of the interlining textile.

This phenomenon has a negative effect in that it makes the back of the fusible interlining adhere to the lining textile (lining, facing, etc.) when the clothing is ironed or pressed.

- due to the penetration of the polymers in the base fabric, the latter is stiffened by the gluing together of the fibers and/or yarns.

The traverse and return phenomena were observed when the use of fusible interlinings first began and many attempts have been made since then to avoid these defects.

Thus, document FR-A-2 177 038 has proposed to achieve an interlining by successively depositing two layers of adhesive on a base fabric. The first layer is achieved by coating a viscous dispersion (paste) containing polymers with a high viscosity and/or a high melting point superior to the temperature required for fusing, directly on the base fabric by means of a silk screen printer.

The second layer is achieved by powdering a powder of fusible polymers with a viscosity and/or a melting point lower than those of the first layer.

The surface of the paste points of the first layer remains adhesive, due to the nature and composition of the compounds making up the latter, until the subsequent drying phase. Thus, the thermofusible material scattered in the form of a fine powder over the coated base fabric settles by gravitation on the entire base fabric, but it adheres more firmly to the paste points.

Since the materials used for the sublayer have a melting point higher than those of the thermofusible layer, they form a shield and, theoretically, the adhesive does not flow through the base fabric when the interlining is bonded on a cloth.

However, since the points of the sublayer have a spherical or ellipsoidal shape, the particles of thermofusible material stick to the entire surface of the paste point, particularly at the point of contact between the paste point and the base fabric; this results in the thermofusible material present at the point of contact flowing through the base fabric, with the sublayer unable to act as a shield during the bonding, thus producing traverses.

Moreover, due to its irregular surface, the sublayer penetrates more or less into the base fabric during the direct coating. Thus, the adhesive surface of the sublayer varies and, as a result, the quantity of particles varies as well, producing a very negative effect on the adhesive forces between the interlining and the cloth and, in particular, on the non homogeneity of these adhesive forces.

BRIEF SUMMARY OF THE INVENTION

A first object of the present invention is to propose a fusible interlining and its manufacturing process which eliminates the limitations or disadvantages of those known in the art.

More particularly, an object of the present invention is to propose a fusible interlining with which the thermofusible material does not flow through the base fabric when it is applied on the cloth.

Another object of the present invention is to propose a fusible interlining and its manufacturing process in which the adhesive is not in contact with the base fabric, and is only in contact with the upper part of the sublayer.

For this purpose, the invention first concerns a process for manufacturing a fusible interlining wherein a base fabric receives a coating of thermofusible polymers distributed in points, characterised in that the following steps are successively carried out:

- depositing a sublayer of polymers, in the form of a cross-linkable paste or a dispersion in a solvent, whose melting point is higher than a predetermined thermofusing temperature, on a transfer medium comprising a regular and smooth surface, by means of a silk screen printer;
- transferring the flat surface points thus obtained onto the base fabric;
- applying the particles of thermofusible polymers on the sublayer;
- running the fusible interlining thus obtained through a heating and/or radiation chamber so as to ensure the cross-linkage and/or melting of the paste or dispersion.

The transfer medium can be a roller or an endless conveyor.

According to one embodiment, the particles of thermofusible polymers are applied by powdering and the polymer particles which are not directly in contact with the points of the sublayer are then drawn up.

According to another aspect, the invention also proposes a fusible interlining characterised in that it is obtained by implementing the process according to the invention.

BRIEF DESCRIPTION OF THE DRAWINGS

Further characteristics and advantages of the present invention will be clearly understood upon reading the following description made with reference to the attached drawings, in which.

DETAILED DESCRIPTION OF THE INVENTION

Figure 1:
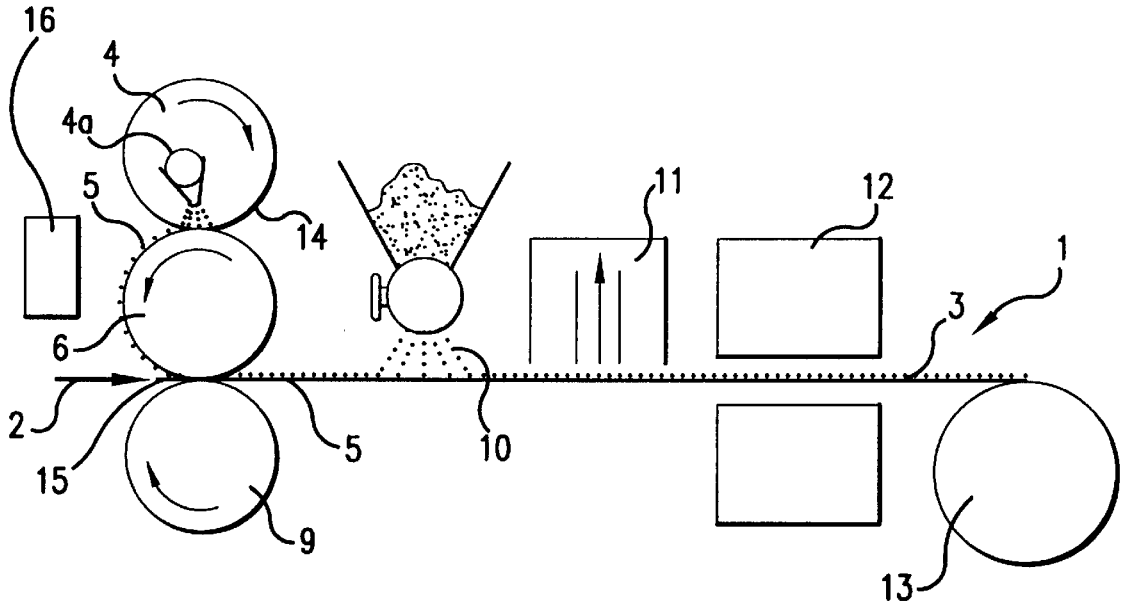
FIG. 1 is a schematic view of a device illustrating the manufacturing process of an interlining according to the invention.

According to the invention, a fusible interlining 1 is manufactured which includes a base fabric 2 comprising points 3 of thermofusible polymers on one of its outer faces.

The base fabric 2 itself can be well known. It is of the same nature as those conventionally implemented in the field of interlining.

It can be a woven, knitted or nonwoven textile. Most often, these textiles are transformed and then undergo finishing operations before being used as a coating base.

Two coating layers of polymers distributed in points 5, 10 are successively applied on the base fabric 2.

For this purpose, the sublayer 5 of polymers is first deposited, in the form of a paste or a dispersion in a solvent such as water, on points distributed on a flat or convex transfer medium 6, 7 comprising a regular and smooth surface. The melting point of these polymers is higher than the thermofusing temperature and therefore to the melting point of the thermofusible polymers.

The transfer medium 6, 7 can be a roller 6 or a transfer conveyor 7, which preferably forms a closed loop moving on transport rollers 8*a*, 8*b*.

This sublayer forming a shield is deposited by means of a screen printer 4. This rotary screen printer, well known in itself, cooperates with a squeegee 4*a*, on the one hand, and with a counter-roller which may consist of either the transfer roller 6 or the transport roller 8*a* of the transfer conveyor 7.

The axes of the screen printer 4 and of the transfer roller 6 or transport roller 8*a* are parallel to one another and perpendicular to the direction of movement of the base fabric 2.

The screen printer 4 makes it possible to implement coating processes in the form of a paste or a dispersion in a solvent such as water.

In the case of wet coating processes, very fine powders of polymers in aqueous dispersion are applied on the medium by a hollow squeegee installed within the rotary roller, which has a thin perforated wall. The squeegee 4*a* produces the passage of the paste through the openings of the screen printer 4.

The composition of the sublayer 5 varies according to the applications. In certain cases, finely ground materials are used whose melting point is higher than that of the thermofusible particles 10, polyethylenes for example. In other cases, chemically reactive materials are used so that their reactivity will result in a melting point which is also higher than that of the thermofusible particles 10, such as aminoplastics, acrylics resins and the urethanes acrylates, polyurethanes, epoxy resins.

In order to achieve a coating paste with these polymers, they are used finely ground and dispersed in water. To obtain a pasty mixture, thickeners can be added if necessary.

This paste is then deposited on the transfer roller 6 or the transfer conveyor 7 and then undergoes transformations intended to transform the solvent partly or completely and/or to melt the finely ground polymer or activate, through radiation of polymers sensitive to radiation sources (such as UV, electron bombardment, etc.). This preliminary treatment 16 of the sublayer 5, prior to its transfer, makes it more homogeneous and consistent so as to simplify its transfer.

Figure 2:
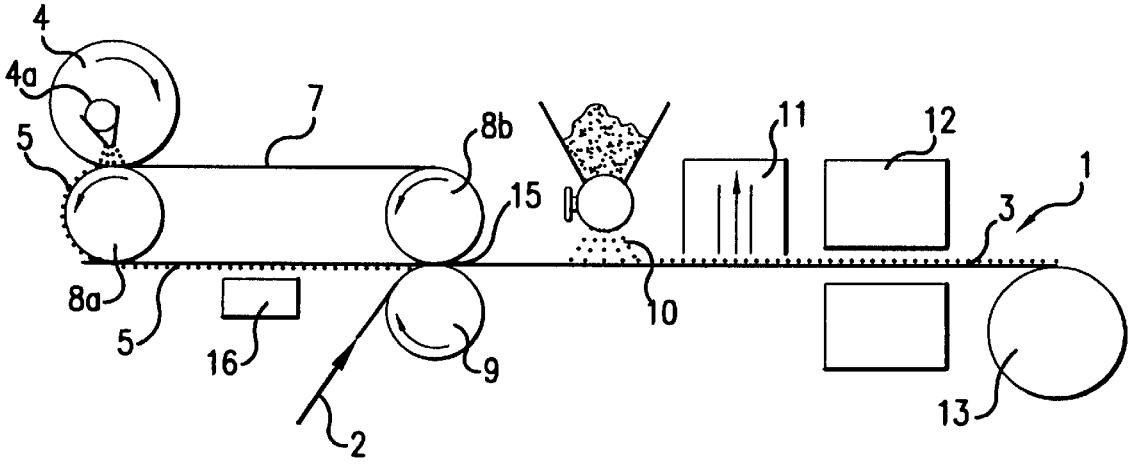
FIG. 2 is a schematic view of another embodiment of the device illustrating the manufacturing process of an interlining according to the invention.

The next step consists in transferring the set of points of the sublayer 5 onto the base fabric 2. To make the transfer possible, the base fabric 2 is pressed, according to the embodiment shown in FIG. 1, between the transfer roller 6 and a counterpressure roller 9; and according to the embodiment shown in FIG. 2, the base fabric 2 is pressed between the transport roller 8*b* of the transfer conveyor 7 and the counterpressure roller 9.

The transfer medium 6, 7 is tangent to the screen printer 4 in a region 14 and to the base fabric 2 in a region 15, respectively, said regions 14, 15 being located on the same plane or on parallel planes. The plane(s) containing the axes of rotation of the screen printer 4, of the transfer roller 6 or transfer conveyor 7, and of the counterpressure roller 9 are perpendicular to the plane of the base fabric 2.

The base fabric 2 is tangent, to each of the two rollers 6, 9 or 8*b*, 9, between which it runs, in region 15.

As a result, since the sublayer 5/base fabric 2 adhesion energy is superior to that of the sublayer 5/transfer medium 6, 7, the transfer takes place at the point of contact between the transfer medium 6, 7 and the base fabric 2.

The points of the sublayer 5 thus transferred have a flat surface and a low thickness and are arranged on the surface of the base fabric 2. Moreover, their surface is adhesive.

A device then makes it possible to scatter the particles of thermofusible polymers 10 on the base fabric 2 coated with the sublayer 5. In this manner, the particles 10 adhere to the surface of the points of the adhesive sublayer 5.

These particles of thermofusible polymers 10 can be polyamide or polyester particles whose size grading is comprised between 60 $\mu$m and 200 $\mu$m. Part of these particles stick to the flat surface of the points of the transferred sublayer 5, and the rest of them remain in contact with the surface of the base fabric 2 but do not adhere to it.

In order to rid the base fabric 2 of the excess of particles 10 and only keep the particles 10 stuck to the flat surface of the points of the sublayer 5, the assembly is submitted to a suction device 11 and vigorous beating.

The base fabric 2 coated with the points 3 of thermofusible polymers then passes through a heating and/or radiation chamber 12, particularly in order to evaporate the solvent contained in the sublayer 5 if necessary, to transform the latter so that its melting point is higher than that of the thermofusible material 10, and to melt the thermofusible particles 10.

The invention also concerns a fusible interlining 1 obtained by implementing the process described above.

Figure 3:
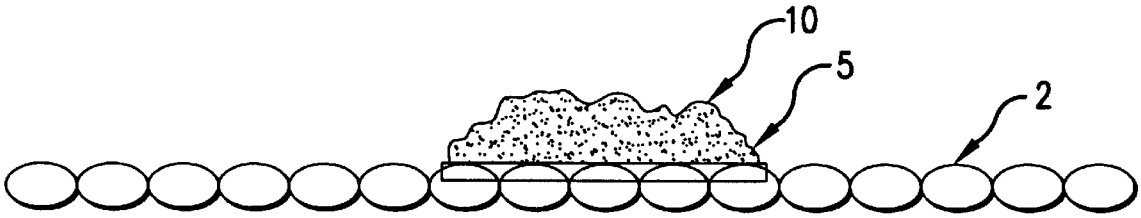
FIG. 3 is a schematic cross-sectional view of a fusible interlining obtained by implementing a manufacturing process according to the invention.

The advantageous properties of the fusible interlining 1 result from the particular arrangement of the particles of thermofusible polymers 10 with respect to the sublayer 5. The latter completely shields off thermofusible particles 10, i.e. these particles 10 are not in contact with the base fabric 2, but only with the upper part of the fine and perfectly flat sublayer 5 (FIG. 3). As a result, when the interlining 1 is bonded on a cloth, the thermofusible particles 10 do not flow into the base fabric 2 under the effect of the temperature and the pressure, since the sublayer coincides exactly with the points of the thermofusible particles 10.

Figure 4:
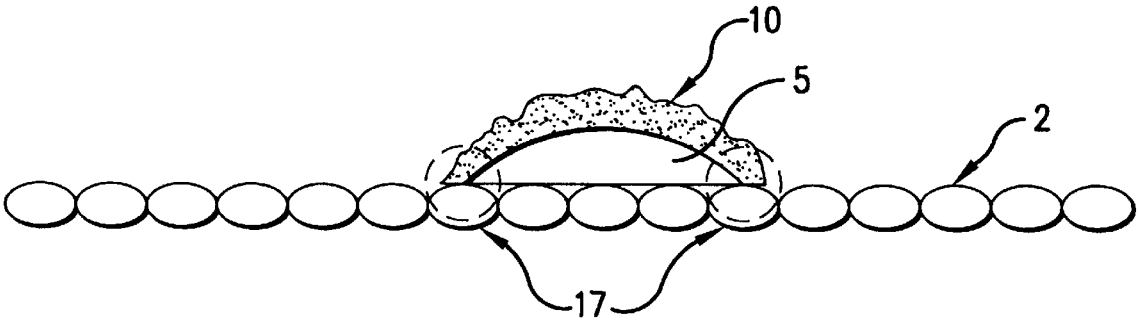
FIG. 4 is a schematic cross-sectional view of a fusible interlining known in the art.

This was not the case with the interlining produced by the prior art, since the scattering of particles on sublayer points coated directly by a screen printer on a base fabric made it possible for certain particles to stick to the periphery of the sublayer points (FIG. 4). As a result, the thermofusible substance 10 could flow through the base fabric 2 at the flow regions 17. This is not possible with the fusible interlining 1 according to the invention, since the sublayer is transferred.

The invention will now be described by means of two examples provided on an indicative but non limiting basis.

EXAMPLE I

Screen printer:

set of points: 75 holes per $cm^2$ diameter of the holes of the screen printer: 300 mm Material of the sublayer: Polyethylene Composition of the paste:

| | |
|---|---|
| polyethylene powder with a size grading of below 80 mm | 25% |
| water | 60% |
| additives | 10% |
| thickener | 5% |

Thermofusible material: Polyamide, in the form of a powder with a size grading comprised between 60 $\mu$m and 200 $\mu$m Base fabric: Knitted textile, single polyester warp with a texturized polyester weft. Weight: 30 $g/m^2$ Thermofusible interlining: Total weight: 42 $g/m^2$, of which 4 g makes up the weight of the sublayer, and 8 g of polyamide

EXAMPLE II

Screen printer:

45 holes per $cm^2$ diameter of the holes: 320 mm

Material of the sublayer:

Acrylic polymer and aminoplastic resin

| | | |
|---|---|---|
| Composition of the paste: | Acrylic polymer | 50% |
| | Aminoplastic resin | 15% |
| | Water | 25% |
| | Miscellaneous | 10% |

Thermofusible material:

Polyamide particles with a size grading comprised between 60 $\mu$m and 200 $\mu$m

EXAMPLE III

Screen printer:

45 holes per $cm^2$ diameter of the holes: 320 mm

Composition of the paste:

urethane acrylate

Thermofusible material:

polyamide particles with a size grading comprised between 60 $\mu$m and 200 $\mu$m Base fabric:

knitted textile, with a texturized polyester weft

I claim:

1. A process for manufacturing a fusible interlining (1) comprising the following steps of:

depositing, by means of a screen printer (4), a sublayer (5) of polymers, in the form of a cross-linkable paste or a dispersion in a solvent, whose melting point is higher than the temperature required for thermofusing, on a transfer medium (6, 7);

transferring said sublayer (5) onto a base fabric (2) by means of a transfer medium (6, 7);

wherein the transfer medium (6, 7) comprises a regular and smooth surface;

applying particles of thermofusible polymers (10) on the sublayer (5) so as to obtain a fusible interlining (1);

running fusible interlining (1) through a heating and/or radiation chamber (12) so as to provide the cross-linkage and/or melting of the paste or dispersion;

wherein the sublayer (5) of the polymers is transferred onto the base fabric (2) by directly applying mutually opposing pressure to both the transfer medium (6, 7) and the base fabric (2), so as to produce a planar sublayer of substantially reduced height, as compared to a pre-transferred sublayer, in the form of a point being parallel to the base fabric surface, thus preventing the polymer particles from directly contacting the base fabric (6, 7).

2. A process according to claim 1, wherein the particles of thermofusible polymers (10) are scattered on the base fabric and in that the thermofusible polymer particles (10) which are not directly in contact with the points of the sublayer (5) are then removed by means of suction and/or beating.

3. A process according to claim 1, wherein the transfer medium is a roller (6).

4. A process according to claim 1, wherein the transfer medium is an endless conveyor (7).

5. A process according to claim 1, wherein the polymers of the sublayer has a melting point hither than the thermofusible particles (10).

6. A process according to claim 1, wherein the polymers of the sublayer (5) is a polyethylene.

7. A process according to claim 1, wherein the polymers of the sublayer (5) is selected from the group consisting of aminoplastic mixtures, acrylic resins, aminoplastic resins, and polyurethanes.

8. A process according to claim 1, wherein the sublayer (5) is submitted, prior to its transfer, to a preliminary treatment so as to make its composition more homogenous.

9. A process according to claim 1, wherein the transfer medium (6, 7) is simultaneously tangent to the screen printer (4) and to the base fabric (2).

10. A process according to claim 1, wherein the particles of thermofusible polymer (10) have a particle size ranging between 60 and 200 $\mu$m.

11. A process according to claim 1, wherein the particles of thermofusible polymer (10) are selected from the group consisting of polyamide, polyester, polyurethane and polyethylene particles.

* * * * *